United States Patent [19]

Mitchell

[11] Patent Number: 4,931,122

[45] Date of Patent: Jun. 5, 1990

[54] STRAIGHT THROUGH LABELLING MACHINE

[75] Inventor: Monte C. Mitchell, Modesto, Calif.

[73] Assignee: B & H Manufacturing Company, Inc., Ceres, Calif.

[21] Appl. No.: 200,359

[22] Filed: May 31, 1988

[51] Int. Cl.[5] ..... B65C 3/16; B65C 9/04

[52] U.S. Cl. ..... 156/215; 53/415; 53/137; 156/449; 156/455; 156/458; 156/566; 156/568; 156/DIG. 13; 156/DIG. 26

[58] Field of Search ..... 156/449, 450, 455, 458, 156/566, 568, DIG. 13, DIG. 26, DIG. 41, 448, 215; 53/415, 137

[56] References Cited

U.S. PATENT DOCUMENTS 3,159,521 12/1964 Pechmann ..... 156/568
3,532,583 10/1970 Thiele ..... 156/568
4,526,645 7/1985 Malthouse et al. ..... 156/568
4,592,796 6/1986 Schlacht ..... 156/568
4,714,515 12/1987 Hoffmann ..... 156/568

FOREIGN PATENT DOCUMENTS 814311 6/1959 United Kingdom ..... 156/455

*Primary Examiner*—Michael Wityshyn
*Attorney, Agent, or Firm*—Flehr, Hohbach, Test, Albritton & Herbert

[57] ABSTRACT

Labelling machine comprising a cylindrical vacuum drum, a feed screw located in relation to the vacuum drum to move cylindrical containers from a starting point to a release point past the vacuum drum with their cylinder axes parallel to the cylinder axis of the vacuum drum and in tangent contact with the vacuum drum, and a continuous drive belt located to contact the sides of containers opposite their sides in contact with the feed screw, said belt serving to spin the containers from the starting point to the release point.

11 Claims, 4 Drawing Sheets

STRAIGHT THROUGH LABELLING MACHINE

This invention relates to a labelling machine, more particularly for the high speed labelling of cylindrical containers.

A very successful machine for labelling containers is that described in U.S. Pat. No. 4,500,386 in which containers are supplied by a star wheel to a vacuum drum on which labels, with adhesive applied to their leading ends and trailing ends, are held by vacuum. Each container is brought into tangential contact with the leading end of a label held on the vacuum drum and the container is then caused to roll between the cylindrical surface of the vacuum drum and what is known as a "roll on pad" which is concentric to the vacuum drum. The container, as it moves along the circular arc thus provided, wraps the label around itself.

The path of containers while under control of the star wheel container feed and the vacuum drum/roll on pad is an S-shaped path which requires change of direction including an inflection at the point of transfer from the star wheel to the vacuum drum/roll on pad.

These changes of direction impose acceleration and high handling loads which limit the speed of labelling.

A straight through labelling machine avoids such changes of direction. (By "straight through" is meant a machine in which the containers proceed in a straight line through the labelling station.) Straight through machines are described in von Hofe U.S. Pat. No. 2,524,945 (Reissue Pat. No. 24,097), Pechman U.S. Pat. No. 3,159,521, Burroughs U.S. Pat. No. 3,300,363, Hoffler U.S. Pat. No. 3,367,822 and Hutchinson U.S. Pat. No. 3,472,722. Belts are employed to move the containers and to spin them to apply labels. The Pechman patent is illustrative. It supplies containers to a vacuum drum by means of a feed screw/timing device (hereinafter referred to as a feed screw); labels with heat activated adhesive are carried by a vacuum drum to the point of contact with a container; and the container with a label applied is released from the vacuum drum and is moved linearly and is caused to spin by an endless belt which also drives the vacuum drum.

However such straight through labelling machines are deficient, among other reasons because there is a sudden change of spin velocity as the container leaves the feed screw and starts to spin by reason of contact with the endless belt. This sudden change of spin velocity imposes high acceleration loads on the container and tends to destabilize it at the very point where maximum stability is desired.

It is an object of the present invention to provide a straight through labelling machine which is capable of high speed operation and which avoids or ameliorates the disadvantages of prior straight through machines.

It is a further and particular object of the invention to provide a straight through labelling machine in which there is no change or a minimum of change of direction, of spin velocity and of translational speed during the entire labeling cycle.

The invention is illustrated by way of example in the accompanying drawings which illustrate certain embodiments of the invention. Referring to these drawings.

Figure 1:
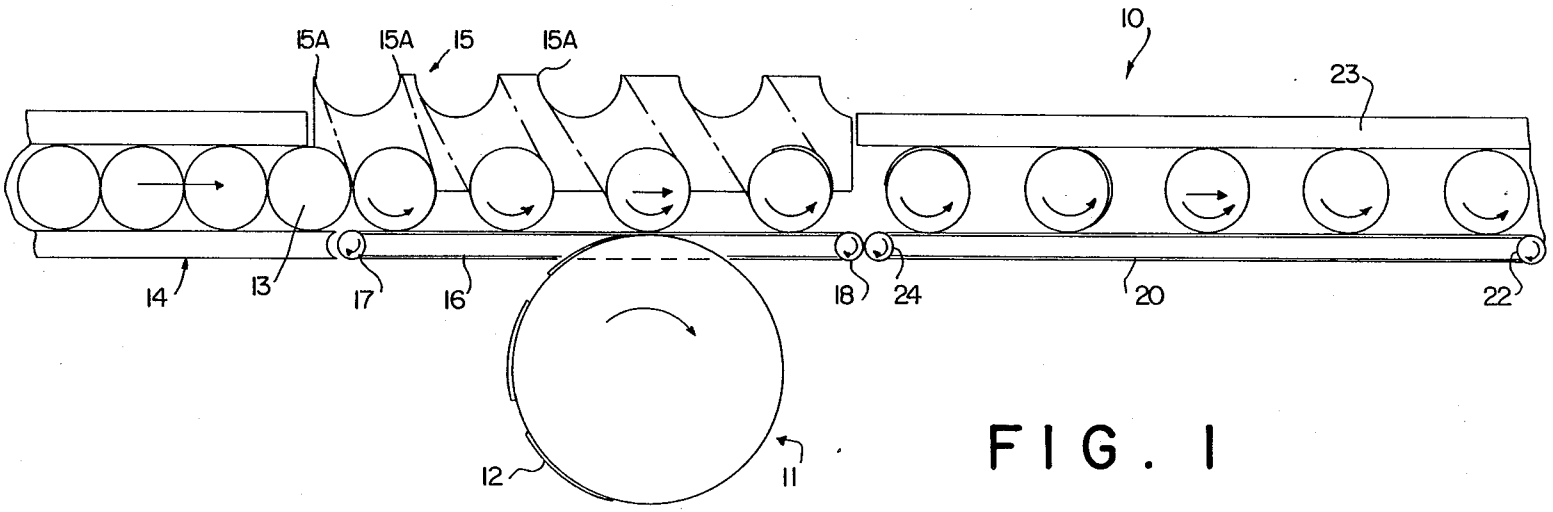
FIG. 1 is a schematic top plan view of one embodiment of the invention employing a single feed screw, a primary container drive belt and a secondary belt.

Referring now to FIG. 1, a labelling machine is shown at 10 having a vacuum drum 11 which carries label segments 12 to be applied to cylindrical containers 13. Other articles than containers may be labelled. Also it should be understood that the segments 12 need not be labels but may be film or sheet material which is wrapped around cylindrical articles for decorative purposes, for added strength or for other purposes than labelling. The labels 12 may be cut from a continuously moving strip of label stock or the labels 12 may be precut and supplied to the vacuum drum from a stack. Suitable label feeds (continuous and stack feeds) are well known in the art. Also cutting mechanisms for cutting individual labels from continuous label stock. See, for example, U.S. Pat. No. 4,108,710 for a label feed and cutting mechanism which are suitable for purposes of the present invention for cutting continuous label stock into separate labels and depositing each label on a continuously rotating vacuum drum. See also U S Pat. Nos. 4,181,553 and 4,500,386.

The containers 13 travel by gravity or other means along a guideway 14 to the end of a feed screw (which serves also as a timing device) 15 which moves the containers forwardly or to the right as viewed in FIG. 1. The containers are also caused to spin in a counterclockwise direction as viewed in FIG. 1 by an endless belt 16 mounted on rollers or pulleys 17 and 18 which are rotatably mounted in the frame of the machine. One of the rollers or pulleys 17, 18 is driven in timed relation to the surface speed from the vacuum drum and the container continues to spin until the label is firmly applied. FIG. 1 illustrates "spot labelling" in which a label is not wrapped entirely around the container. If full, wraparound labelling is employed the feed screw 15 preferably extends far enough to completely wrap the label around the container. However it is not essential that a label be completely applied to a container by the time it leaves the exit end of the feed screw although such is preferred. It may be sufficient to wrap a sufficient portion of the label around the container that it is firmly applied.

The belt 16 is driven by an independent drive which, however, is preferably coordinated with the speed of the vacuum drum so that the container 13 spins at a rate such that its surface speed equals, and preferably somewhat exceeds the surface speed of the vacuum drum. The surface speed of the container will be the resultant of its spin velocity and its translatory velocity. The feed screw extends beyond the point of tangency of the container 13 and the vacuum drum 11 a sufficient distance so that, before the container is released by the feed screw, the label 12 is securely applied to the container.

The labelled (or partially labelled) container is then released to a downstream component including a second endless belt 20 mounted on rollers pulleys 22 and 24 and including a roll on pad 23. The velocity of belt 20 can either match that of belt 16, in which case the translational velocity of the containers will decrease (due to the absence of the feedscrew in that area), or the velocity of belt 20 can be greater than that of belt 16 to minimize or eliminate this effect.

Other downstream container handling equipment may be employed than that which is shown but the equipment shown is preferred because it is simple and it continues the straight line path of the containers and can operate at the desired speed. Of course the labelled containers are ultimately removed from the machine as shown in FIG. 1.

Figure 2:
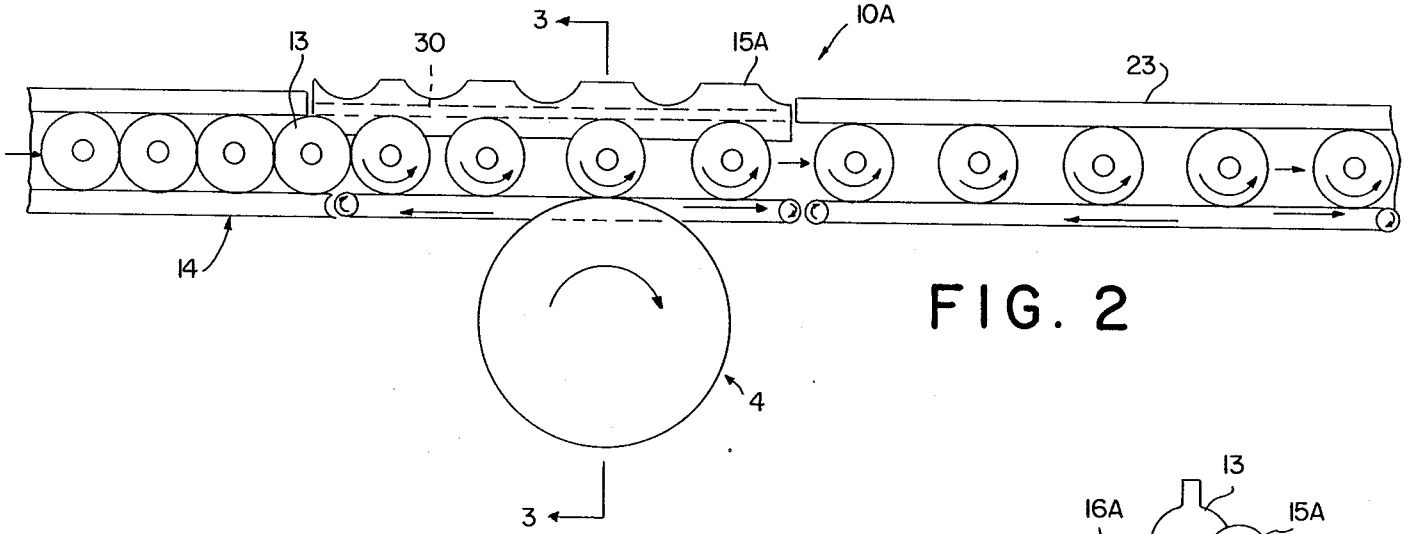
FIG. 2 is a similar view of a similar machine which employs a pair of feed screws.
Figure 3:
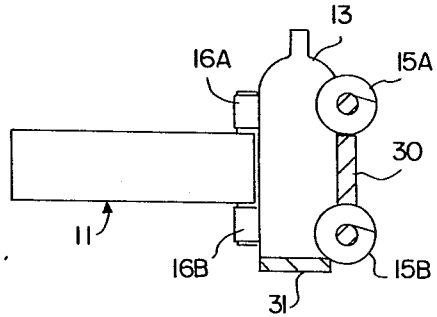
FIG. 3 is a section taken along the line 3—3 of FIG. 2.

Referring now to FIGS. 2 and 3, the components of the labelling machine 10A are for the most part the same as the components of the machine 10 in FIG. 1 and are similarly numbered. However, as shown in the section of FIG. 3 there are two feed screws 15A and 15B, one being located near the upper end of the container 13 and the other being located near the lower end of the container 13; there is a primary roll on pad 30 between the feed screws; and there are two primary drive belts 16A and 16B, one above and the other below the vacuum drum. A bottom support 31 for the containers is also shown in FIG. 3. There is, of course, a bottom support in all of the embodiments.

Advantages of the machine of FIGS. 2 and 3 include the fact that the container, especially if it is a tall container and/or is a lightweight plastic container, is held and moved more stably by the primary roll on pad 30 which, as shown by the broken lines in FIG. 2, extends substantially the length of the feed screws 15A and 15B thus ensuring adequate roll on of the label 12 and ensuring getting the container up to the desired speed. In addition the roll-on pad nested between the feed screws improves initial roll-down of the label onto the container.

Figure 4:
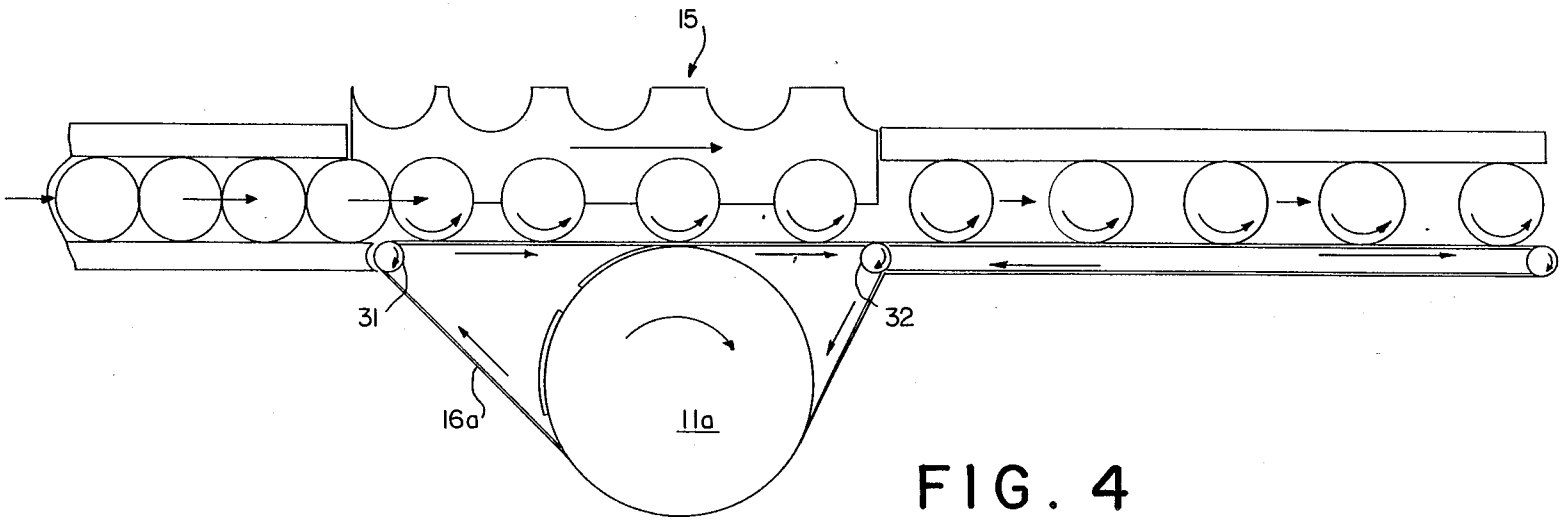
FIG. 4 is a view similar to FIG. 1 of another embodiment of the invention employing a single feed screw and a vacuum drum driven by the same drive belt that spins the containers.

Referring now to FIG. 4, the machine there shown is similar, except for the combination belt and vacuum drum drive, to the machine of FIG. 1. The same reference numerals are employed for the most part in the machine of FIG. 4. The primary container drive belt 16A is driven by the vacuum drum 11A. The belt 16A may be wrapped around a portion of the surface of the drum 11A having the same diameter as the portion of the surface of the drum which carries the labels 12, in which case the belt 16A and the containers 13 will move at a linear speed which is equal to the surface speed of the drum.

Figure 5:
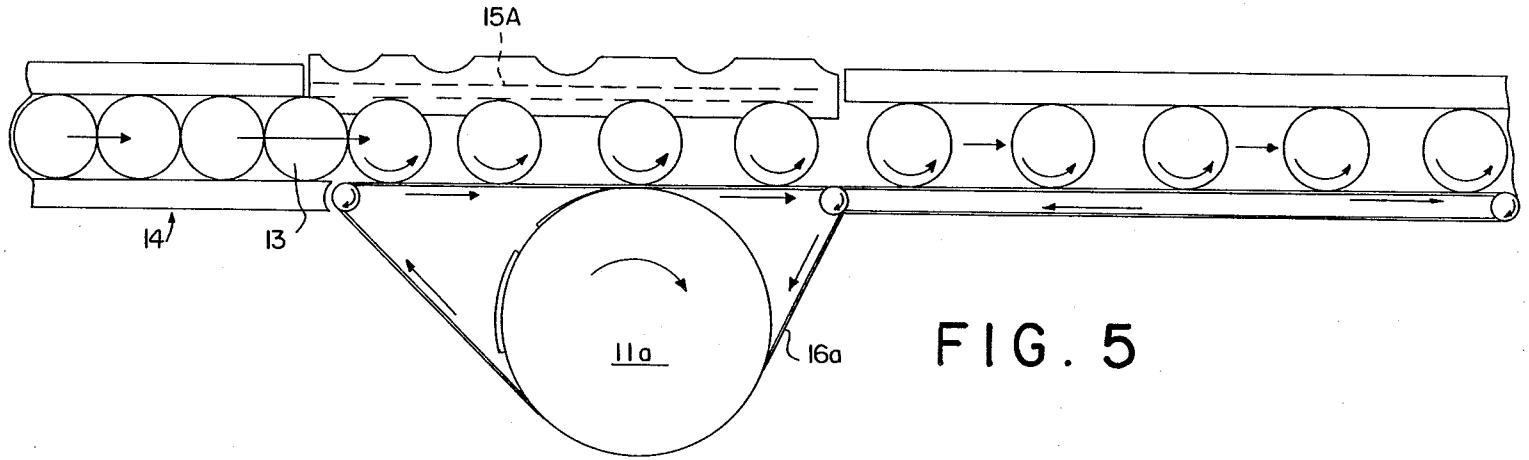
FIG. 5 is a similar view of a machine which employs a pair of feed screws.

Referring now to FIG. 5 in which reference numerals are the same as in FIG. 4 except for the feed screws, there are dual feed screws 15A and 15B and a primary roll on pad 30 as in FIGS. 2 and 3. The operation of the machine of FIG. 5 will be apparent from the description above of FIGS. 1, 2 and 3.

It will there be apparent that a new and useful high speed straight through labelling machine has been provided.

I claim:

1. A machine for wrapping segments of sheet or film material about the cylinder surfaces of cylindrical articles, said machine comprising:

(a) a cylindrical vacuum drum rotatable about its cylinder axis and capable, when so rotating, of picking up such segments, in sequence, by their leading ends at a segment receiving station, holding the segments on its cylinder surface, rotating the segments in turn to a segment applying station and releasing each segment at the segment applying station (b) a transport adapted to continuously transport such cylindrical articles from a receiving station in a straight line to a release station with their cylinder axes parallel to the cylinder axis of the vacuum drum and, at a point between and spaced a substantial distance from said receiving and release stations, causing each cylindrical article to come into tangent contact with a segment on the vacuum drum at said segment applying station and (c) means for imparting to each article during its travel between the receiving and release stations a spinning motion about its cylinder axis, such spinning motion commencing at a point substantially before such tangent contact and continuing to a point substantially after such tangent contact.

2. In a machine for applying segments of sheet or film material to the cylinder surfaces of cylindrical articles. such machine including a rotatable, cylindrical vacuum drum capable of receiving such segments on its cylinder surface, holding each segment on such surface while rotating, and releasing each segment to the cylinder surface of such an article as it moves past and in tangent contact with the cylinder surface of the vacuum drum, the improvement which comprises:

(a) a helical article feed arranged to transport such articles with their cylinder axes parallel to the cylinder axis of the vacuum drum in a linear path past the cylinder surface of the vacuum drum, such helical artical feed being spaced from said drum surface such that each container, as it moves past the vacuum drum, is pressed into tangent contact with a segment on the drum and (b) endless belt means arranged to contact the surface of such container opposite the container surface in contact with the helical article feed (c) such helical article feed and endless belt means defining and forming a path of container travel commencing substantially in advance of such tangent contact of the article wih the vacuum drum and terminating substantially beyond such contact, whereby each container is caused to travel linearly at the desired speed and to spin about its cylinder axis at a desired speed without substantial acceleration or deceleration until such segment is firmly applied to the cylindrical article.

3. The machine of claim 2 in which the endless belt means moves at a speed such that the surface speed of each container exceeds the surface speed of the vacuum drum.

4. The machine of claim 2 wherein the endless belt means and the vacuum drum are driven independently.

5. The machine of claim 2 wherein the endless belt means and vacuum drum have a common drive.

6. The machine of claim 5 wherein the endless belt means is driven by the vacuum drum.

7. The machine of claim 2 wherein the helical article feed is a single feed and timing screw.

8. The machine of claim 2 wherein the helical article feed is in the form of a pair of feed and timing screws, one of which is located near the tops of the articles and the other of which is located near the bottoms of the articles.

9. The machine of claim 8 in which there is a roll on pad located between the pair of feed and timing screws which contacts the surface of the container opposite the endless belt means.

10. A method of applying segments of film or sheet material to the cylinder surfaces of cylindrical articles which comprises:

(a) providing a cylindrical vacuum drum capable of receiving such segments successively at a segment receiving station, holding each segment on its cylinder surface and transporting the thus held segment, by rotation of the drum about its cylinder axis, to a segment applying station (b) operating said vacuum drum as set forth in step (a)

(c) transporting such cylindrical articles in succession with their cylinder axes parallel to the cylinder axis of the vacuum drum, such transporting being through a straight line path from a first location to a second location, such path being so positioned that between the first location and second location each container is brought into tangent contact with the leading end of a segment on the drum, such contact occurring a substantial distance from the first location and from the second location and (d) imparting to each container while it is being transported from the first location to the second location a spinning motion about its cylinder axis, whereby each segment, in turn, is released by the vacuum drum, picked up by the container and wrapped around the container at least partially while the container is undergoing simultaneous linear movement and spinning motion.

11. The method of claim 10 wherein said straight line path is defined and formed by a feed screw and an endless belt with each article being confined between the feed screw and endless belt and being moved along the straight line path by the feed screw and being caused to spin by movement of the belt.

* * * * *